United States Patent [19]

Miller

[11] Patent Number: 4,813,785

[45] Date of Patent: Mar. 21, 1989

[54] MIXING STRUCTURE FOR PAINT COLORANT IN A DISPENSING APPARATUS

[75] Inventor: William A. Miller, Buffalo Grove, Ill.

[73] Assignee: Harbill Manufacturing Company, Ill.

[21] Appl. No.: 78,294

[22] Filed: Jul. 27, 1987

[51] Int. Cl.[4] ..... B01F 7/18

[52] U.S. Cl. ..... 366/251; 74/665 GC; 74/15.2; 366/252; 366/282; 366/283; 366/605

[58] Field of Search ..... 366/605, 279, 292, 297–300, 366/244–245, 247, 249, 251, 252, 254, 282, 283; 74/665 GC, 12, 15.2, 16

[56] References Cited

U.S. PATENT DOCUMENTS

| | | | |
|---|---|---|---|
| 673,143 | 4/1901 | Sette | 366/297 X |
| 1,498,217 | 6/1924 | Walker | 366/300 X |
| 2,333,951 | 11/1943 | O'Neill | 366/297 X |
| 2,374,430 | 4/1945 | Hexter | 366/297 X |
| 2,445,216 | 7/1948 | Foltz | 366/247 X |
| 2,488,447 | 11/1949 | Tangen et al. | 366/279 X |
| 2,848,019 | 8/1958 | Corbin et al. | 366/605 X |
| 2,860,447 | 11/1958 | Muller et al. | 74/15.2 X |
| 3,724,561 | 4/1973 | Merrels | 74/15.2 X |
| 4,299,500 | 11/1981 | Bassetti | 366/605 X |

FOREIGN PATENT DOCUMENTS

| | | | |
|---|---|---|---|
| 811385 | 8/1951 | Fed. Rep. of Germany | 366/249 |

*Primary Examiner*—Philip R. Coe
*Assistant Examiner*—Stephen F. Gerrity
*Attorney, Agent, or Firm*—Wood, Dalton, Phillips, Mason & Rowe

[57] ABSTRACT

An apparatus for mixing a liquid colorant in a container. A flexible cable is rotated about its length to drive rotatable agitating structure in the container. Where a plurality of containers, each having agitating structure and an associated cable are used, a motor driven gear simultaneously rotates all cables to effect rotation of the agitating structures.

14 Claims, 2 Drawing Sheets

FIG. 1
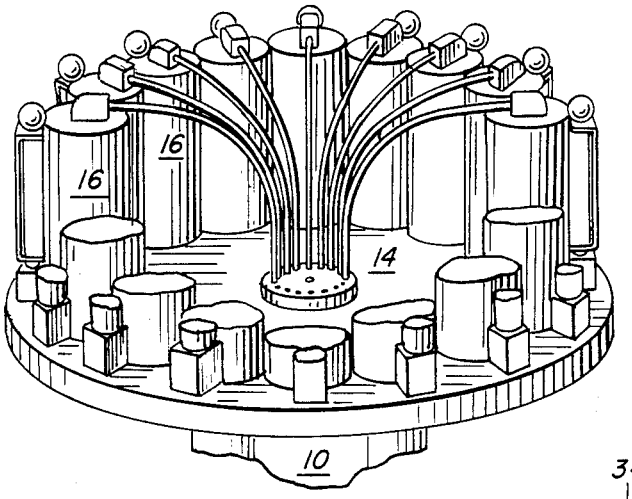
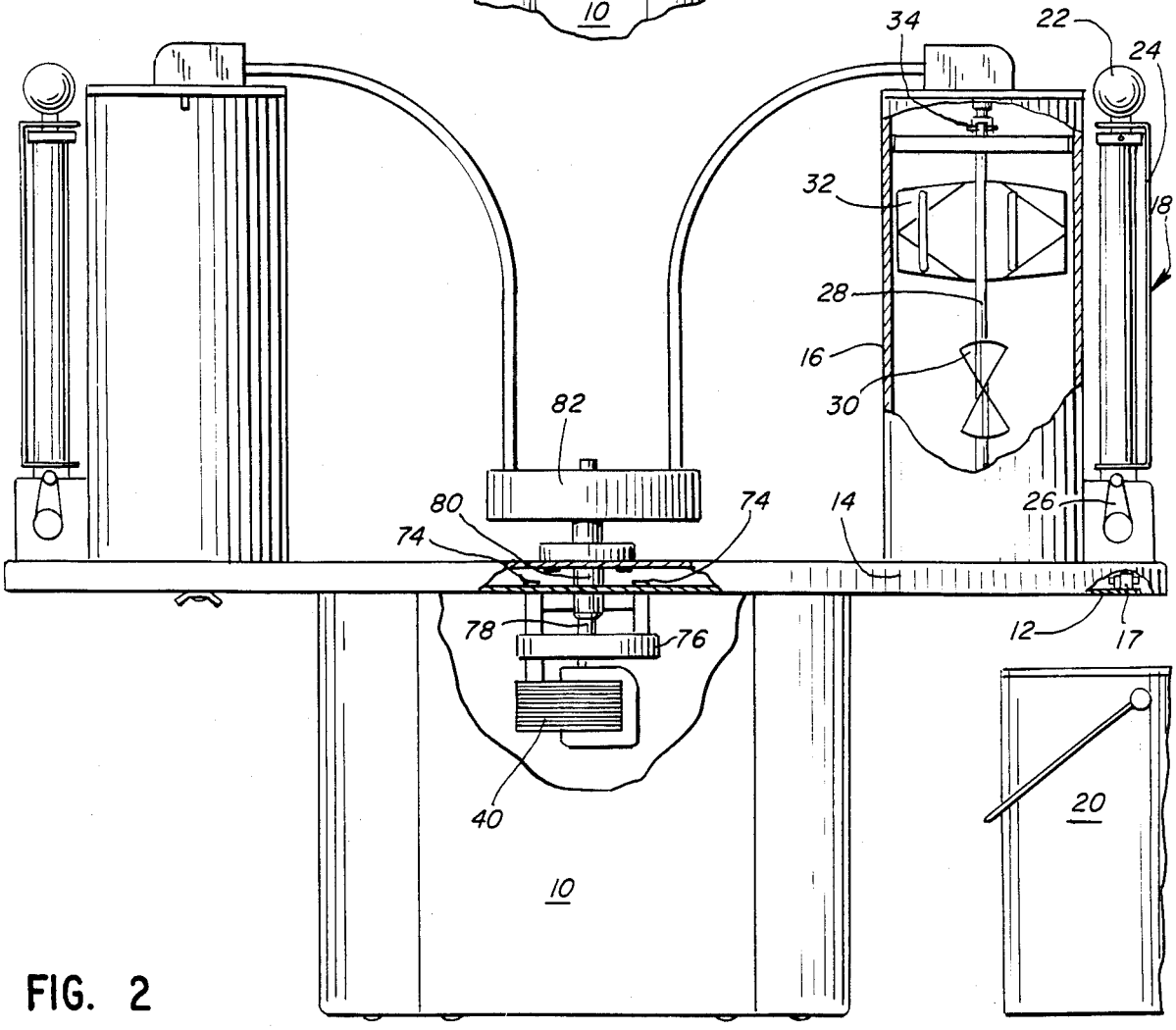
FIG. 2

FIG. 3
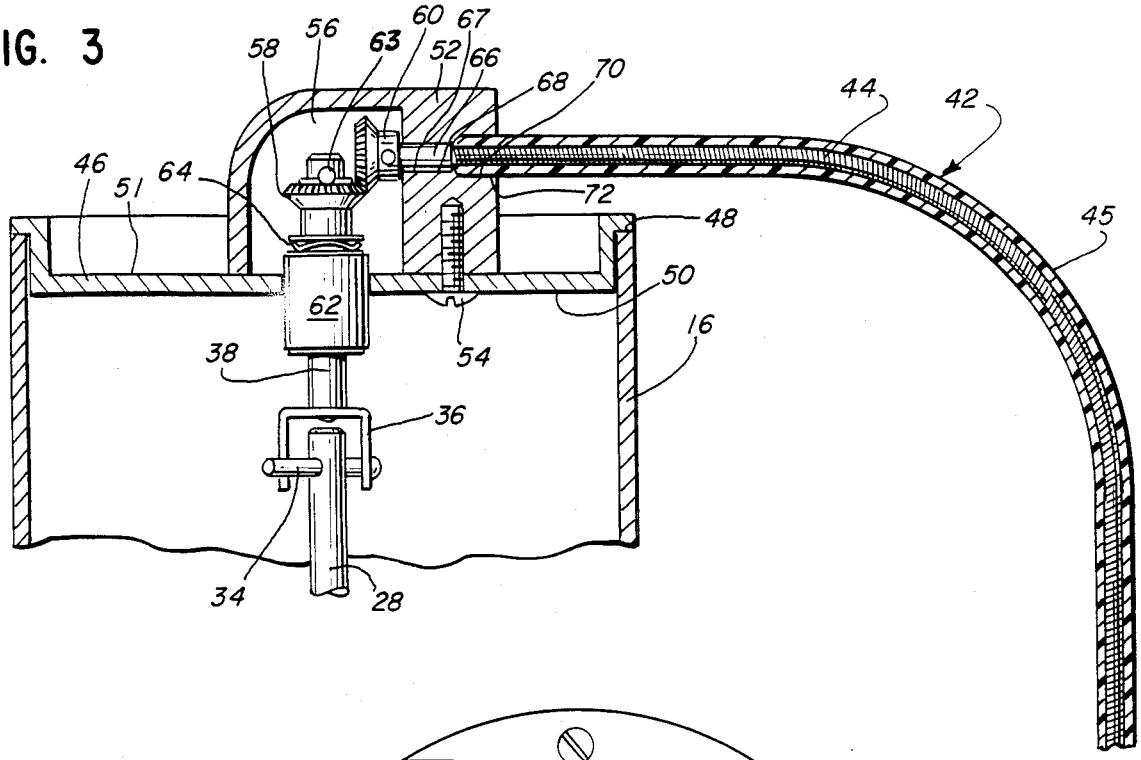
FIG. 4
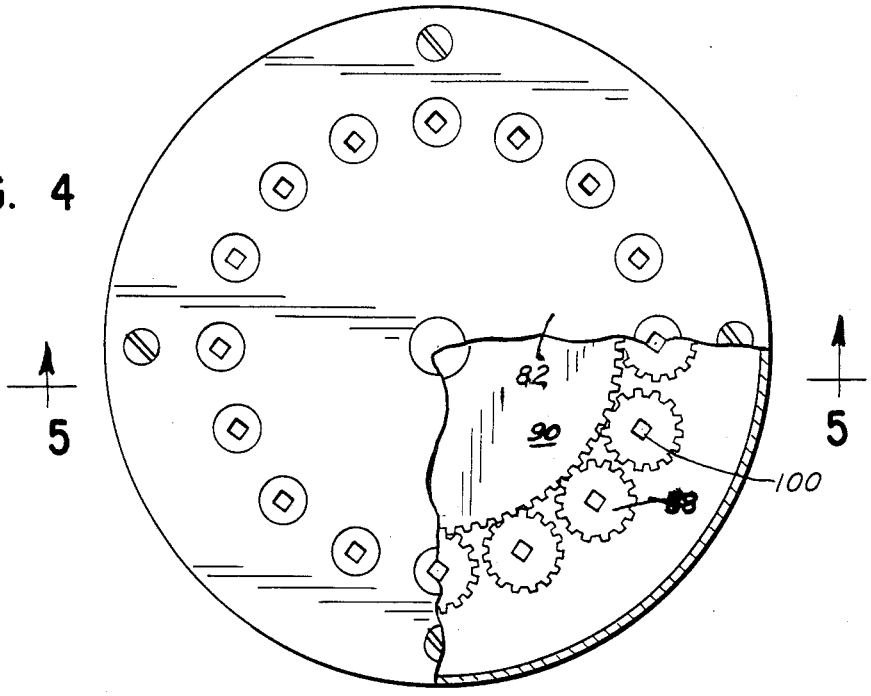
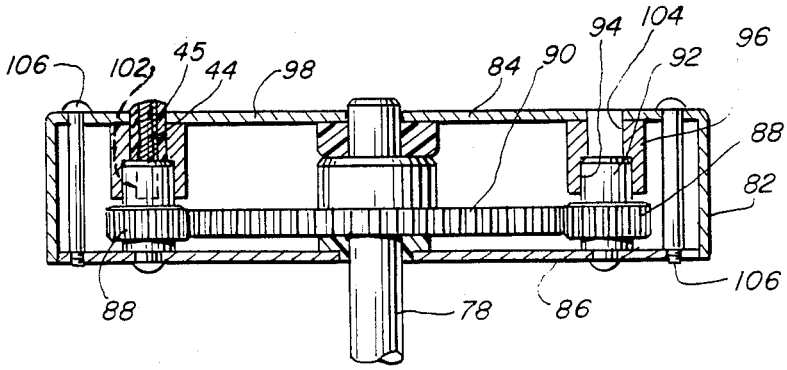
FIG. 5

MIXING STRUCTURE FOR PAINT COLORANT IN A DISPENSING APPARATUS

BACKGROUND OF THE INVENTION

1. Field of the Invention

This invention relates to apparatus for dispensing colorant selectively from a plurality of containers and, more particularly, to structure for agitating the colorant in the containers.

2. Background Art

To avoid having to separately inventory different color paints, paint retailers use a common base that is tinted with a colorant on a per order basis. An elevated turntable supports a plurality of containers in which the colorant is stored in liquid form and metering structure is provided to dispense predetermined amounts of each colorant from the containers into the base as the desired color dictates.

To maintain uniformity from one paint batch to the next, it is essential that the colorant in each container be thoroughly mixed. To accomplish this, it is conventional to equip each container with a rotary paddle which is periodically operated to agitate the colorant.

SUMMARY OF THE INVENTION

The present invention is directed to an apparatus for mixing a liquid colorant in a container. A flexible cable is rotated about its length to drive rotatable agitating structure in the container.

Where a plurality of containers with separate colorant supplies are used, each container has its own agitator and associated cable connected to the agitator. A motor driven gear simultaneously rotates the cables, through a gear on each cable.

Each cable has a surrounding sheath with opposite ends connected to a fixed housing associated with the drive gear and a block on the container to thereby maintain a predetermined bend in the cable. Each cable drives a gear about a horizontal axis in mesh with a gear on the agitator rotatable about a vertical axis. The motor driven gear is spaced below the block on the container and is rotatable about a vertical axis. The gears on the cable ends in mesh with the motor driven gear are rotatable about axes parallel to the axis of the motor driven gear and spaced equidistantly therefrom.

BRIEF DESCRIPTION OF THE DRAWINGS

FIG. 1 is a perspective view of a liquid colorant mixing and dispensing apparatus with a plurality of cable driven agitators for colorant containers according to the present invention;

FIG. 2 is an enlarged elevation view of the colorant mixing and dispensing apparatus of FIG. 1;

FIG. 3 is an enlarged, fragmentary section view of the connection between a drive cable and an agitator on one of the colorant containers;

FIG. 4 is an enlarged, plan view of drive structure for the cables; and

FIG. 5 is a section view of the drive structure taken along line 5—5 of FIG. 4.

DETAILED DESCRIPTION OF THE DRAWINGS

Referring initially to FIGS. 1 and 2, the colorant mixing and dispensing apparatus according to the present invention consists of a cylindrical base 10, having fixed thereto a disk-shaped support 12 for a turntable 14 carrying sixteen separate cylindrically-shaped colorant containers 16, each of which is identical in construction. Bearings 17 are provided on the support 12 to smoothly guide rotation of the turntable 14. Each container 16 has a supply of liquid colorant and structure at 18 for dispensing a metered quantity of liquid from its associated container 16.

In operation, an open can 20, or other suitable receptacle containing a liquid base, is placed on a support surface for the apparatus so that the can 20 is beneath the turntable 14 in the path of the metering/dispensing structure 18. The turntable 14 is indexed to situate the desired colorant container 16 over the can 20. A plunger (not shown) associated with the metering/dipensing structure 18 is controlled by a vertically movable handle 22 which is raised a predetermined amount, gauged by a scale 24, to force a measured amount of the colorant into the can 20 upon release of a valve (not shown) through an associated crank handle 26. The operation is repeated for each required colorant until the desired porportions are deposited into the can 20 after which the contents thereof is mixed to produce a uniform, desired color.

The present invention is concerned with structure for mixing the colorant in each container 16. A rotary shaft 28 is mounted in coaxial relationship with each container and carries a lower paddle 30 and upper paddle 32 for stirring the colorant in the container 16 as the shaft 28 rotates. As shown in FIGS. 2 and 3, the shaft 28 has a pin 34 extending therethrough at right angles to the length of the shaft 28. The pin 34 is driven by a downwardly opening U-shaped yoke 36 carried on a shaft 38 which is coaxial with shaft 28. Rotation of the shaft 38 is imparted by a drive motor 40 through a flexible cable 42 having an inner rotatable core 44 and an outer protective sheath 45.

A lid 46 is removably press fit over the open end 48 of each container 16. The lid 46 has a cylindrical body 50 with an upwardly facing surface 51 to which a block 52 is secured by a bolt 54. The block 52 has a hollow 56 in which first and second meshing bevel gears 58, 60 on the shaft 38 and cable 42 reside. The lid 46 carries a bushing 62 in which the shaft 38 is journalled for rotation. The bevel gear 58 is carried on the shaft 38 and resides between the bushing 62 and a stop pin 63 and is biased upwardly into engagement with the gear 60 by a wave washer 64.

The gear 60 has a reduced diameter sleeve 66 which is journalled for rotation in a reduced diameter portion 67 of a stepped through bore 68 in the block 52. The larger diameter portion 70 of the bore 68 closely accepts the end 72 of the cable sheath 45 so that the cable 42 is held in a generally horizontal orientation in the vicinity of the block 52. Because the cable 42 is flexible, the lid 46 on the container 16 can be readily removed with the block 52 as a unit to facilitate checking and replenishing of the supply of colorant in the container 16. The U-shaped drive element 36, upon the lid 46 being removed, slides freely off of the pin 34 and, upon the lid 46 being replaced, slides readily back over the pin 34 for driving engagement therewith.

The drive for the individual cables 42 will now be described with respect to FIGS. 1, 2, 4 and 5. The motor 40 is fixed to the bottom of the support 12 as by bolts 74. Through a speed reduction mechanism 76, rotation is imparted to the shaft 78, which is journalled for rotation in bushing 80 extending vertically through both the support 12 and the turntable 14. Supported above the bushing 80 and in fixed relationship thereto is a gear housing 82 consisting of an upper, inverted cup-shaped half 84 and a disk-shaped base plate 86. The upper housing half and cover plate 82 cooperatively capture and support gears 88 for rotation relative thereto. The gears 88 correspond in number to the cables 42 and each is in mesh with a central drive gear 90 carried by motor shaft 78. The axes of rotation of gears 88 are spaced equidistantly from the axis of rotation of shaft 78. Each gear 88 has a cylindrical fitting 92 journalled for rotation in a bore 94 in a boss 96 depending from an upper, flat wall 98 of the housing half 84. Each fitting 92 has a blind bore 100 with a square cross section. The fitting 92 makes keyed connection with the end 102 of the cable core 44 so that the cable rotates with the gear 88 about its length. The cable sheath 45 is press fit into a reduced diameter portion 104 of the bore 94 in the boss 96 so that the cable extends generally vertically upwardly from the gear housing 82. The gear housing half 84 and base plate 86 are held together by bolts 106, thereby facilitating assembly and repair of the gear housing 82 and associated gears 88, 90.

I claim:

1. A liquid mixing apparatus comprising:

a container for storing a supply of liquid and having an open upper end through which liquid can be introduced to the container;

a lid removably press fit to the container so that the lid closes the open container end;

an agitator;

means in the container for mounting the agitator for rotation within the container;

a flexible cable having spaced ends;

drive means for rotating the cable about its length;

means for connecting one of the spaced cable ends to the rotating drive means to be rotated thereby;

rotating means on the lid and extending into the container for imparting rotation to the agitator with the lid press fit to the container; said rotating means being disengaged and separated from the agitator upon the lid being removed from the container so that the agitator remains within the container and is disabled; and means for connecting the other cable end to the rotating means on the lid for imparting rotation from the cable to the rotating means on the lid.

2. The liquid mixing apparatus according to claim 1 including a gear, and wherein there is a second container with a removable lid and a second agitator and a second flexible cable with spaced ends through which the second agitator is driven by the rotating drive means, said drive means comprises a motor with a rotatable shaft, means for mounting the gear on the rotatable shaft for rotation therewith, a gear is keyed to an end of each cable and means are provided for mounting the gears on the cable ends in mesh with the gear on the motor shaft so that the cables can be simultaneously rotated by the motor shaft gear.

3. The liquid mixing apparatus according to claim 2 including means for individually separating and thereby selectively disconnecting the one ends of the first and second cable from the drive means so that the drive means can be operated selectively with none, either one or both of the agitators rotating.

4. The liquid mixing apparatus according to claim 3 further including means for dispensing liquid from each container, a base, a turntable, means mounting the turntable to the base in elevated relationship to a support surface for said apparatus and means mounting the containers to the turntable for rotation therewith so that the containers can be selectively positioned to dispense liquid at a desired location.

5. The liquid mixing apparatus according to claim 3 wherein there is a sheath surrounding substantially the entire length of each cable between its ends, first and second blocks, means mounting one block fixedly on the lid of each container, and means securing the sheath at the other end of each cable to a block to thereby maintain a predetermined orientation of the other cable ends.

6. The liquid mixing apparatus of claim 3 wherein said disconnecting means includes cooperating keying means on each of the cable gears and the one ends of the first and second cable for selective connection and disconnection of the one cable ends and cable gears by relative movement thereof axially with respect to the rotational axes of the cable gears.

7. The liquid mixing apparatus of claim 6 wherein there are sheaths surrounding each of the first and second cables, said rotating drive means has a housing with first and second surfaces bounding first and second bores, said first and second bores closely receiving the sheaths on the first and second cables so as to maintain the cables in predetermined orientations.

8. A liquid mixing apparatus according to claim 1 further including means for dispensing liquid from said container, a base, a turntable, means mounting the turntable to the base in elevated relationship to a support surface for said apparatus and means mounting the container to the turntable for rotation therewith so that the container can be indexed to dispense liquid at a desired location.

9. The liquid mixing apparatus according to claim 1 wherein there is a deformable sheath surrounding the cable, a block, and means for mounting the block in fixed position on the container lid, said block having a bore to closely accept the sheath at the other cable end to thereby maintain a predetermined orientation of the other cable end.

10. The liquid mixing apparatus according to claim 9 wherein the agitating means has a rotatable shaft, the means for connecting the other cable end comprises a gear on the shaft of the agitating means and a gear on the other cable end for meshing with the gear on the shaft, and means journal the gear on the other cable end for rotation in the block.

11. The liquid mixing apparatus according to claim 10 wherein said first and second gears comprise bevel gears rotatable about axes at right angles to each other.

12. The liquid mixing apparatus of claim 1 including means for disengaging the one cable end from the drive means to disable the agitating means.

13. The liquid mixing apparatus of claim 12 wherein said means for disengaging comprises means for removably press fitting the one cable end into and frictionally maintaining the one cable end in operative relationship with the drive means.

14. A liquid paint colorant mixing and dispensing apparatus comprising:

a base;

a turntable;

means mounting the turntable for rotation relative to the base about a vertical axes and in elevated relationship to a surface supporting the apparatus;

first and second containers for retaining separate supplies of liquid paint colorant and each having an open end;

means mounting the first and second containers to the turntable at locations spaced from said vertical axis and for rotation with the turntable;

means for controlled dispensing of colorant from the first and second containers;

first means rotatable about a vertical axis for agitating the colorant in said first container;

second means rotatable about a vertical axis for agitating the colorant in said second container;

a first flexible cable having a sheath and spaced ends;

a second flexible cable having a sheath and spaced ends;

a drive motor;

a drive gear rotatably driven by the drive motor about a vertical axis;

first and second gears in mesh with the drive gear and simultaneously rotatably driven thereby about vertical axes;

means for releasably keying the one ends of the first and second cables to the first and second driven gears for rotation therewith so that rotation of the drive gear can selectively rotate one, both or none of the first and second cables about their length depending upon whether one, both or none of the one cable ends is keyed to its respective first and second driven gears, said keying means including means for interconnecting the one cable ends and driven gears upon the one cable ends being moved vertically relative to the driven gears in one direction and for releasing the one cable ends upon the one cable ends being moved relative to the driven gears vertically relative to the driven gears oppositely to said one direction; and means on each of the first and second lids for imparting rotation from the other cable ends to the first and second agitating means, said rotation imparting means each including means for disengaging the rotation imparting means from the agitating means upon the lid associated therewith being removed from its associated container, said rotation imparting means each further including means for frictionally engaging the sheath on each of the cables to maintain the sheath in a predetermined orientation at the other cable end, whereby each of said agitating means can be disabled by either removing the lid on the container associated with each agitator or by disconnecting the one end of the cable associated with each agitator from its associated driven gear.

* * * * *

UNITED STATES PATENT AND TRADEMARK OFFICE

CERTIFICATE OF CORRECTION

PATENT NO. : 4,813,785

DATED : March 21, 1989

INVENTOR(S) : William A. Miller

It is certified that error appears in the above-identified patent and that said Letters Patent is hereby corrected as shown below:

On column 3, line 5, after the word "half" insert --84--.

Signed and Sealed this

Twenty-eighth Day of November 1989

*Attest:*

JEFFREY M. SAMUELS

*Attesting Officer*

*Acting Commissioner of Patents and Trademarks*